US009754745B2

(12) United States Patent
Suchoff

(10) Patent No.: US 9,754,745 B2
(45) Date of Patent: Sep. 5, 2017

(54) METHODS AND APPARATUS FOR IMPROVED RELAY CONTROL

(75) Inventor: Michael Suchoff, Chapel Hill, NC (US)

(73) Assignee: Raritan Americas, Inc., Somerset, NJ (US)

( * ) Notice: Subject to any disclaimer, the term of this patent is extended or adjusted under 35 U.S.C. 154(b) by 1630 days.

(21) Appl. No.: 12/917,087

(22) Filed: Nov. 1, 2010

(65) Prior Publication Data

US 2012/0106021 A1 May 3, 2012

(51) Int. Cl.

| | |
|---|---|
| ***H01H 9/00*** | (2006.01) |
| ***H01H 47/00*** | (2006.01) |
| ***H01H 51/22*** | (2006.01) |
| ***H01H 51/30*** | (2006.01) |
| ***H01H 47/32*** | (2006.01) |
| ***H01F 7/18*** | (2006.01) |
| ***H01H 47/04*** | (2006.01) |

(52) U.S. Cl.

CPC ..... *H01H 47/32* (2013.01); *H01F 7/1805* (2013.01); *H01H 47/04* (2013.01); *H01H 47/325* (2013.01)

(58) Field of Classification Search

CPC ..... H01F 7/1805; H01H 47/04; H01H 47/325
USPC ..... 361/160
See application file for complete search history.

(56) References Cited

U.S. PATENT DOCUMENTS

| | | | |
|---|---|---|---|
| 4,720,762 A | 1/1988 | Estes | |
| 5,055,962 A | 10/1991 | Peterson | |
| 5,986,896 A | 11/1999 | Gibart et al. | |
| 2004/0095263 A1 | 5/2004 | Thomas | |
| 2005/0162144 A1 | 7/2005 | Kernahan | |
| 2007/0290738 A1 | 12/2007 | Wendt | |
| 2009/0213520 A1 | 8/2009 | Bedingfield | |
| 2009/0251929 A1* | 10/2009 | Choi | 363/21.02 |
| 2009/0284889 A1 | 11/2009 | Lenz | |

FOREIGN PATENT DOCUMENTS

| | | |
|---|---|---|
| EP | 1146532 A2 | 10/2001 |
| JP | 2009289671 A | 12/2009 |

OTHER PUBLICATIONS

International Search Report and Written Opinion of corresponding PCT Application PCT/US11/58263, dated Feb. 21, 2012.

(Continued)

*Primary Examiner* — Thienvu Tran
*Assistant Examiner* — Lucy Thomas
(74) *Attorney, Agent, or Firm* — Vorys, Sater, Seymour and Pease LLP; Vincent M DeLuca

(57) ABSTRACT

Methods and apparatus provide for: at least one electromechanical relay including a coil and at least one pair of contacts, the contacts transitioning between a de-energized state and an energized state in response to current through the coil; a microcontroller having at least one tri-state output operating to produce ON, OFF, and FLOAT states; and a driver circuit operating, in conjunction with the tri-state output of the microcontroller, to control the current through the coil of the relay such that: (i) a transition of the tri-state output from OFF to FLOAT maintains the contacts of the relay in their de-energized state through the transition, and (ii) a transition of the tri-state output from ON to FLOAT maintains the contacts of the relay in their energized state through the transition.

20 Claims, 5 Drawing Sheets

(56) References Cited

OTHER PUBLICATIONS

International Preliminary Report on Patentability and Written Opinion of corresponding PCT Application PCT/US11/58263, dated Feb. 21, 2012.
EP 11 83 8581 Supplementary European Search Report dated Nov. 4, 2014.

* cited by examiner

METHODS AND APPARATUS FOR IMPROVED RELAY CONTROL

BACKGROUND

The invention relates to methods and apparatus for controlling the delivery of power to a load, and more particularly relates to power control techniques that improve reliability and reduce power consumption.

Information technology (IT) equipment rooms (also known as data centers) utilize hundreds or even thousands of units of IT equipment. Each piece of IT equipment receives primary power by plugging into an outlet of a power distribution unit ("PDU"). A PDU is also a piece of IT equipment and typically includes: (a) a high power inlet from which power is received (typically from a panel board); (b) multiple lower power outlets; and (c) (optional) circuit breakers or fuses to protect the outlets from over current conditions (short circuits, etc.). PDUs are often designed to report certain status information over a communication and/or input/output interface, including: (a) the voltage being supplied to a given PDU's inlet, (b) how much power is flowing in the inlet and each outlet, and (c) the trip state (whether voltage is present) of each circuit breaker.

Additionally, each PDU may include the capability of turning the output voltage on and off in response to microcontroller signaling. This capability permits some level of software control over the power being delivered from each output of the PDU to much, if not most, of the of the IT equipment. FIGS. 1A-1B illustrate a block diagram and a timing diagram, respectively, of a conventional system 10 for controlling a single output of a PDU via a microcontroller 12. The system 10 includes the microcontroller 12, an electromechanical relay 14, and a driver transistor 16. As is known in the art, the microcontroller 12 is capable of producing a signal on a general-purpose-input-output (GPIO) pin that controls the state of the power (120V AC) delivered to the output of the PDU, labeled AC LOAD. For brevity and clarity, this description will not go into extensive detail as to the hardware, firmware, and/or software functionality of the microcontroller 12. Suffice it to say that there are numerous conditions under which it is desirable for the microcontroller 12 to turn on, turn off, and float the signal on the GPIO pin. It is noted that while there may be tens, hundreds, or thousands of GPIO pins in the system 10, the description here is concerned with one such pin, which description may be extended to other GPIO pins in the system 10.

As illustrated in the top plot of FIG. 1B, the GPIO pin exhibits a tristate output, where the state of the GPIO pin may be OFF (e.g., 0 volts), ON (e.g., 1 volt), or FLOAT (e.g., a high impedance input). When the GPIO pin is OFF, the potential is at a logic low (e.g., 0 volts) and the pin is capable of sinking current (into a relatively low impedance). When the GPIO pin is ON, the potential is at a logic high (e.g., 1 volt) and the pin is capable of sourcing current (from a relatively low impedance). When the GPIO pin is at the FLOAT state, the pin operates as a relatively high impedance input, and assumes a potential dictated by the circuitry external to the microcontroller 12.

With reference to FIG. 1A and the middle and bottom plots of FIG. 1B, the electromechanical relay 14 includes a coil and at least one set of contacts. It is assumed that the relay 14 is "normally open," which means that when the coil is not energized (no current is flowing through the coil), the contacts assume an OFF (open) state and the path between the set of contacts is open. In the OFF state, there is no current path from the 120V AC node to the AC load. When the coil is energized, where current is flowing through the coil, a magnetic field produced by the coil causes the contacts to assume an ON state and the path between the set of contacts is closed. In the ON state, there is a current path from the 120V AC node to the AC load, and the load is energized.

The driver transistor 16 controls the current through the coil of the relay 14 in response to the potential on the GPIO pin. In the illustrated example, the driver transistor 16 is an n-channel MOSFET. As such, when the when the GPIO pin is ON (placing about 1 volt on the gate), the driver transistor 16 turns on, provides a current path (from drain to source), and draws current through the coil. It is assumed that the impedance through the coil and the driver transistor 16 is such that the current through the coil is about 33 mA when the GPIO pin is ON. As discussed above, the current through the coil pulls in the contacts and the path from the 120V AC node to the AC load is established. When the GPIO pin is OFF, the pin is a current sink and charge is drawn from the gate, resulting in about 0 volts of bias from gate to source on the driver transistor 16. Thus, the driver transistor 16 turns off, the current path from drain to source is interrupted, and no current flows through the coil. As discussed above, the lack of current through the coil permits the normally open contacts to separate, and the path from the 120V AC node to the AC load is terminated.

As noted above, the GPIO pin may also assume a FLOAT state, whereby the pin operates as a relatively high impedance input. In such state, the GPIO pin will assume some voltage dictated by the circuitry external to the microcontroller 12. Such voltage is illustrated as being somewhere between ON and OFF in FIG. 1B. Although not shown in FIG. 1A, the driver transistor 16 will include some shunt resistance between gate and source. Thus, when the GPIO pin is in the FLOAT state, although the pin assumes a high impedance input characteristic, the shunt resistance of the driver transistor 16 will discharge the gate, resulting in about 0 volts of bias on the driver transistor 16. Thus, the driver transistor 16 turns off, the current path from drain to source is interrupted, no current flows through the coil, the contacts separate, and the path from the 120V AC node to the AC load is terminated.

It is not desirable for the relay 14 to change state when the GPIO pin transitions from ON or OFF to the FLOAT state. The conventional system 10 does not present a problem when the GPIO pin transitions from OFF to the FLOAT state if one assumes that the potential on the gate of the transistor 16 is insufficient to pull current through the coil. Indeed, the relay 14 remains OFF (contacts open) through such a transition. Unfortunately, the conventional system 10 presents a significant problem when the GPIO pin transitions from ON to the FLOAT state, because the relay 14 transitions from ON (contacts closed) to OFF (contacts open) through the transition.

Although the FLOAT state of the GPIO pin may be intentionally set and/or avoided by way of software control, such state may also be inadvertently attained in any number of ways. For example, via electromagnetic interference (EMI), or some type of reset condition in the microcontroller 12 (such as a power cycle, a new firmware or software reset, and/or a user manual reset). Unfortunately, the system 10 of the prior art PDU disadvantageously turns off the relay 14 and interrupts the 120V AC power to the load when the microcontroller 12 resets and the GPIO pin transitions from ON to the FLOAT state. Such interruption of the power to the load may lead to very significant, and unwanted, actions by the IT equipment drawing power from the PDU. This problem is exacerbated by the large numbers of separate IT equipment drawing power from respective relays of the PDU, and the potentially large number of respective PDUs sourcing power to still further IT equipment.

The conventional system 10 also presents another significant problem in the context of power dissipation in the PDU. Consider that an IT equipment room with thousands of units of IT equipment will require thousands of relays 14 and associated driver transistors 16. The average power dissipation in the circuit for a single load is: I×V=33 mA×12=396 mW. Multiplying this power dissipation product by thousands of independent loads, one can see how inefficient the prior art system 10 really is.

This power inefficiency problem of the system 10 has been addressed in the prior art by modifying the current, to the coil of the relay 14 after the contacts have initially closed. This technique recognizes the physical electromechanical characteristics of the coil and contacts of the relay 14. In particular, a higher level of current in the coil (and thus a higher magnetic field and force) is required to overcome the inertia of the normally open contacts (which are often held open with some sort of spring) and force the contacts to close. This level is called the "turn on current" for the coil and is specified by the relay manufacturer. Once closed, the contacts require a lower level of magnetic force to remain closed, which is intuitive because, once closed, the inertia has been overcome. This level is called the "hold current" for the coil and is also specified by the relay manufacturer. Some prior art relay driver circuits employ a first current to turn. ON the relay, and a second, lower, current to hold the relay closed. This technique can improve the efficiency of the PDU considerably.

Although the prior art systems address some inherent disadvantages of the conventional PDU systems, the known solutions are unsatisfactory in the context of both the aforementioned undesirable power interruptions to the load upon a microcontroller resent and the power dissipation inefficiencies. There are, therefore, needs in the art for new methods and apparatus for controlling the power delivery to the load, which address the rest issue, the efficiency issue, and a related issue of system reliability.

SUMMARY OF THE INVENTION

Methods and apparatus provide for: at least one electromechanical relay including a coil and at least one pair of contacts, the contacts transitioning between a de-energized state and an energized state in response to current through the coil; a microcontroller having at least one tri-state output operating to produce, ON, OFF, and FLOAT states; and a driver circuit operating, in conjunction with the tri-state output of the microcontroller, to control the current through the coil of the relay such that: (i) a transition of the tri-state output from OFF to FLOAT maintains the contacts of the relay in their de-energized state through the transition, and (ii) a transition of the tri-state output from ON to FLOAT maintains the contacts of the relay in their energized state through the transition.

Other aspects, features, and advantages of the present invention will be apparent to one skilled in the art from the description herein taken in conjunction with the accompanying drawings.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF PREFERRED EMBODIMENTS

Although one or more embodiments of the invention may be designed for use in a PDU intended for IT equipment applications, and is here illustrated as used in such a PDU, this is not required. Various aspects of the invention are suitable for use in any application requiring control of power to a load through a relay or set of relays.

Figure 1A:
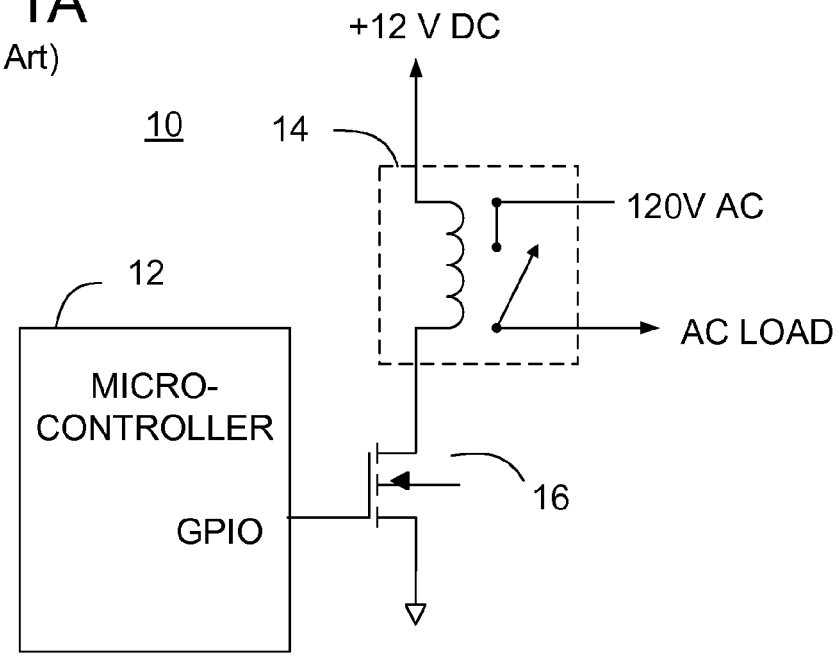
FIG. 1A (Prior Art)
FIG. 1A is a block diagram of a system for controlling power delivery to a load using a microcontroller and relay circuit in accordance with the prior art.
Figure 1B:
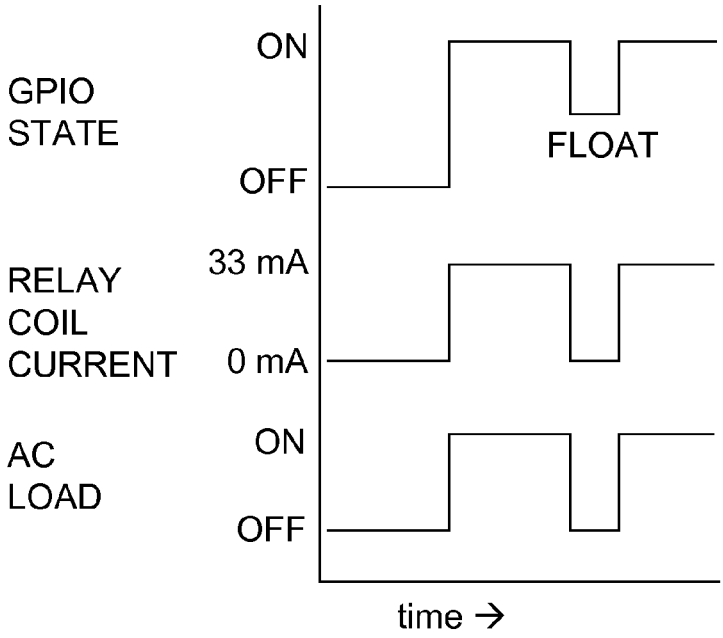
FIG. 1B (Prior Art)
FIG. 1B is timing diagram of some of the signals within the system of FIG. 1A.
Figure 2:
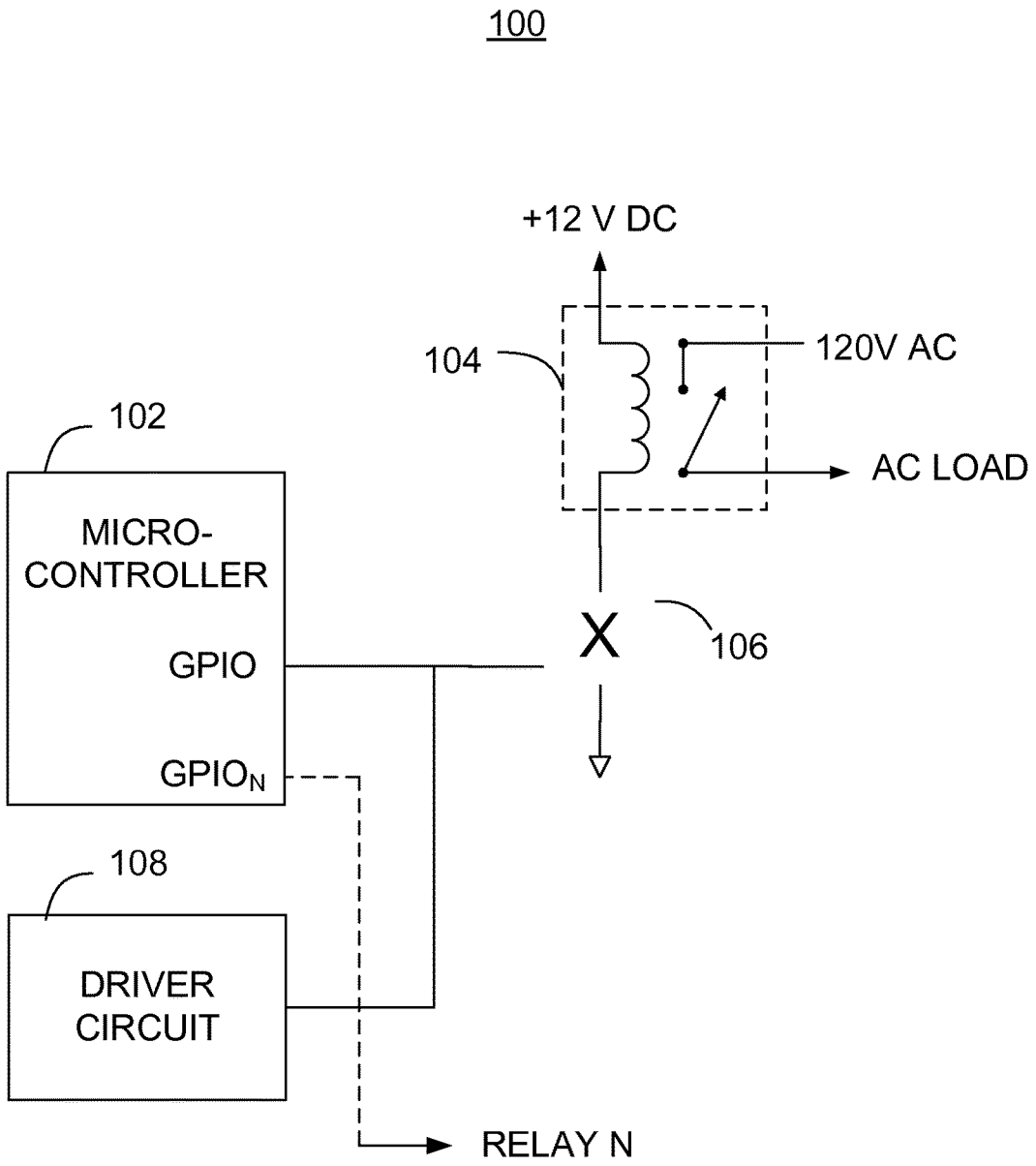
FIG. 2 is a block diagram of a system for controlling power delivery to a load using a microcontroller and relay circuit in accordance with one or more embodiments of the present invention.

Reference is now made to FIG. 2, which is a block diagram of a system 100 for controlling power delivery to a load (labeled AC LOAD) using a microcontroller 102, a relay circuit 104, and a switch circuit 106 in accordance with one or more embodiments of the present invention. The system 100 also includes a driver circuit 108, which provides unique and advantageous functionality to the system 100 over prior art techniques.

The microcontroller 102 operates to execute software/firmware instructions in order to achieve desirable operation of the relay circuit 104. More particularly, software/firmware being executed by the microcontroller 102 may command the state of any number of GPIO pins thereof. In general, there may be N such GPIO pins on a given microcontroller 102.

For purposes of discussion, there are a number of characteristics and definitions relating to the GPIO pins of the microcontroller 102 that are best established early and used by reference later in this description. By way of definition, a given GPIO pin is capable of operating as a tri-state output, where the state of the GPIO pin may be OFF, ON, or FLOAT, depending on the commands established by software/firmware being executed on the microcontroller 102.

The OFF state is defined as a logic "low" level, which may be any suitable voltage potential (often about 0 volts, or ground), and in such state the GPIO pin is capable of sinking current (into a relatively low impedance). The ON state is defined as a logic "high" level, which again may be any suitable voltage potential. The actual voltage of the GPIO pin in the ON state is often dictated by the operating DC supply voltage to the microcontroller 102. By way of example, such logic high voltage level may be anywhere between about 0.333 to about 5 VDC (with reference to ground), although lower and higher voltage levels are also possible. In the ON state, the GPIO pin is capable of sourcing current at the logic high voltage level (from a relatively low source impedance). The FLOAT state of the GPIO pin is defined in terms of a relatively high impedance input, which assumes a voltage potential dictated by the circuitry external to the microcontroller 102.

The microcontroller 102 may be implemented utilizing any of the known technologies, such as commercially-available microprocessors, digital signal processors, any of the known processors that are operable to execute software and/or firmware programs, programmable digital devices or systems, programmable array logic devices, or any combination of the above, including devices now available and/or devices which are hereinafter developed. By way of example, the microcontroller 102 may be implemented using the STM32 ARM MCU, which is available from a company called STMicroelectronics.

For purposes of discussion, there are also a number of definitions relating to the characteristics of the relay circuit 104 that are also best established early and used by reference later in this description. The relay circuit 104 may be implemented by way of at least one electromechanical device, including a coil and at least one pair of contacts. The coil produces magnetic force as a function of the current through the coil, and the contacts are in magnetic communication with the coil. A sufficiently high magnetic force on the contacts, resulting from sufficiently high current through the coil, will cause the contacts to change state, namely, either open or close.

In the case of "normally-open" contacts, a de-energized state is characterized by the contacts being open and there being no current path therebetween. The de-energized state of normally-open contacts exists at rest (no coil current) and when there is insufficient current through, and magnetic force from, the coil to act on the contacts. In contrast, an energized state of normally-open contacts is characterized by the contacts being closed and there being a current path therebetween. The energized state of normally-open contacts exists when there is sufficient current through, and magnetic force from, the coil to move the contacts from their normally-open condition to the closed condition. For purposes of example, the embodiments herein assume that the relay 104 includes normally-open contacts, which is a useful configuration for controlling the power to the AC LOAD.

It is noted, however, that the invention also contemplates other embodiments wherein normally-closed contacts may be useful. In the case of "normally-closed" contacts, the de-energized state is characterized by the contacts being closed and there being a current path therebetween. The de-energized state of normally-closed contacts exists at rest (no coil current) and when there is insufficient current through, and magnetic force from, the coil to act on the contacts. The energized state of normally-closed contacts is characterized by the contacts being open and there being no current path therebetween. The energized state of normally-closed contacts exists when there is sufficient current through, and magnetic force from, the coil to move the contacts from their normally-closed condition to the open condition.

The functionality of the coil and contacts of the relay 104 may be characterized by three current levels: NO-current, TURN-ON current, and HOLD-current. The NO-current condition is defined by the condition in which there is substantially zero current flowing through the coil, in which case the contacts are de-energized as defined above.

The TURN-ON current level is defined by the condition in which there is sufficient current flowing through the coil, and therefore sufficient magnetic force, to move the contacts from their de-energized state to their energized state. In the case of normally-open contacts, the TURN-ON current level must be sufficient to overcome the inertia of the normally-open contacts (which are often held open with some sort of spring) and force the contacts to close. In the case of normally-closed contacts, the TURN-ON current level must again be sufficient to overcome the inertia of the normally-closed contacts and force the contacts to open. The TURN-ON current level is obviously higher than the NO-current level, but is also higher than the HOLD-current level. The TURN-ON current level may be considered the minimum level sufficient to transition the contacts from the de-energized state to the energized state, or it may be considered a range of currents between the minimum level and any reasonable level above such minimum.

The HOLD-current level is defined by the condition in which there is sufficient current flowing through the coil, and therefore sufficient magnetic force, to maintain the contacts in their energized state (assuming that the contacts are already in their energized state). Once the contacts, have attained their energized state (by applying TURN-ON current to the coil), the contacts will maintain the energized state, even when a lower level of current flows through, and a lower magnetic force is produced by, the coil. Thus, the HOLD-current level may be considered a minimum level sufficient to maintain the contacts in the energized state (assuming that they already were energized), or it may be considered a range of currents between the minimum level up to, but not as high as, the minimum TURN-ON current.

Figure 3:
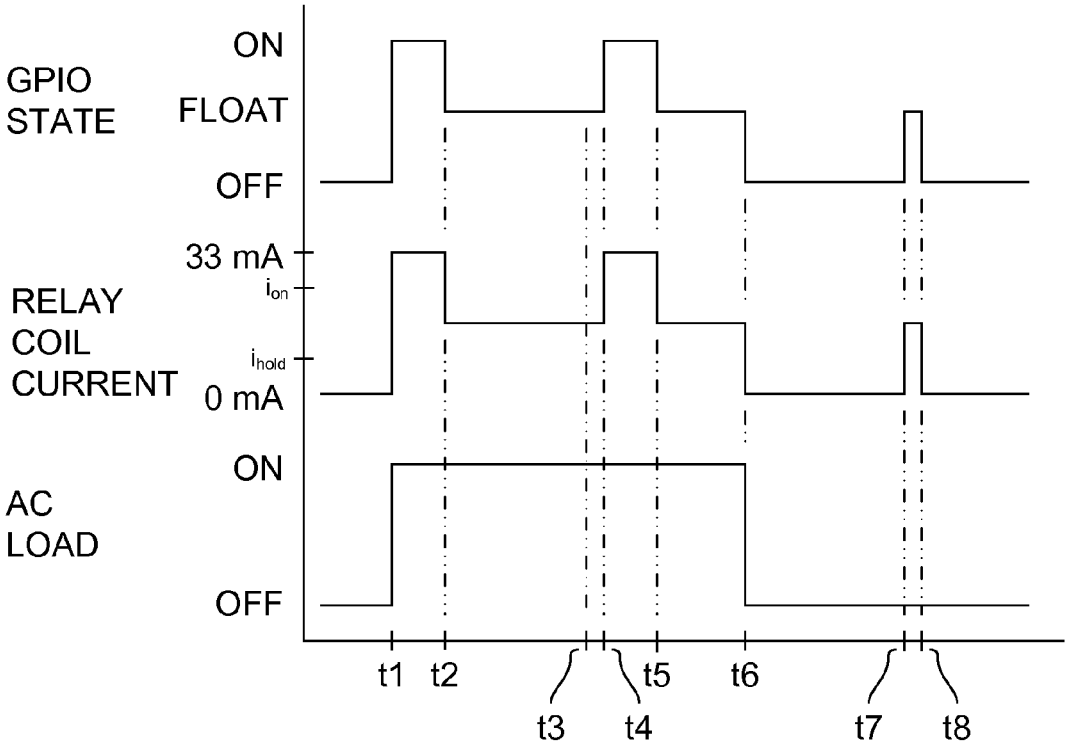
FIG. 3 is timing diagram of some of the signals within the system of FIG. 2.

Given the above definitions, the driver circuit 108 operates, in conjunction with the tri-state output of the GPIO pin of the microcontroller 102, to drive the switching circuit 106 and control the current through the coil of the relay 104 in order to achieve desirable circuit performance. Reference is now made to FIG. 3, which illustrates some plots of signals within the system 100. The performance of the driver circuit 108 is characterized by one or more of the scenarios discussed below.

There is substantially NO-current flowing through the coil when the tri-state output GPIO pin is in the OFF state. As illustrated in the plots of FIG. 3, between times 0 to t1; t6 to t7; and t8 and thereafter, the GPIO pin is in the OFF state, the relay coil current is OFF (about 0 mA) and there is no power delivered to the AC LOAD through the contacts of the relay 104 (the contacts are de-energized, open).

There is TURN-ON current through the coil when the tri-state output GPIO pin is in the ON state. As illustrated in the plots of FIG. 3, between times t1 to t2; and t4 to t5, the GPIO pin is in the ON state, the relay coil current is at or above the TURN-ON level and power is delivered to the AC LOAD through the contacts of the relay 104 (the contacts are energized, closed). The minimum TURN-ON current level is generally illustrated by the level $i_{on}$, and in this example, the actual coil current level is above $i_{on}$, at about 33 mA.

There is HOLD-current through the coil when the tri-state output GPIO pin is in the FLOAT state. As illustrated in the plots of FIG. 3, between time=t2 to t4; t5 to t6; and t7 to t8, the GPIO pin is in the FLOAT state, the relay coil current is at or above the minimum hold current, $i_{hold}$, and less than the minimum turn-on current level $i_{on}$. In this example, the HOLD-current level is at about 15 mA and power is delivered to the AC LOAD through the contacts of the relay 104 (the contacts are energized, closed) only under certain conditions as will be discussed in more detail below.

Notably, the third functional characteristic of the driver circuit 108, that there is HOLD-current through the coil when the tri-state output GPIO pin is in the FLOAT state, leads to some very advantageous results.

The microcontroller 102 may command (with intent) the GPIO pin to the FLOAT state in order to reduce the power dissipation in the coil of the relay 104 and the switching circuit 106. For example, the microcontroller 102 may operate to command the GPIO pin to the ON state for a sufficient period of time to permit the contacts to achieve their energized state, and substantially soon thereafter, command the tri-state output to the FLOAT state to maintain the contacts in their energized state. Referring again to FIG. 3, the microcontroller 102 commands the GPIO pin to the ON state between time=t1 to t2 (which is a sufficient period of time to permit the contacts to achieve their energized, closed, state). During this time, the power dissipation in the coil of the relay 104 and the switching circuit 106 is equal to 12×0.033=396 mW of power. Substantially soon thereafter (for example, soon enough to derive some power savings benefit) the microcontroller 102 commands the GPIO pin to transition from the ON state to the FLOAT state, at time=t2, and then remain in the FLOAT state between time=t2 to t3, which maintains the contacts of the relay 104 in the energized state. During this time, the power dissipation in the coil of the relay 104 and the switching circuit 106 is equal to 12×0.015=180 mW of power. Thus, the overall efficiency of the system 100 may be significantly improved by employing the HOLD-current level to the coil of the relay 104 whenever practical.

Notably, the transition of the tri-state output GPIO pin from ON to FLOAT (at time=t2) does not interrupt the power delivered to the AC LOAD. Rather, the driver circuit 108, in conjunction with the microcontroller 102, sets the current in the coil at the HOLD-current level and therefore maintains the contacts of the relay in their energized state through the transition.

Further, any unexpected command of the GPIO pin to the FLOAT state by the microcontroller 102, such as due to a reset or the like, maintains the state of the contacts just prior to the unexpected condition. For example, consider the conditions of the system 100 from time=t2 to just prior to time=t3. During that time, the microcontroller 102 expectedly and intentionally commands the GPIO pin to the FLOAT state (and thereby holds the contacts of the relay 104 in the energized state. If at time=t3, the microcontroller 102 unexpectedly commands the GPIO pin to the FLOAT state (such as due to a reset) the contacts of the relay 104 remain in the energized state (there is no change) through the unexpected condition.

After the unexpected condition (e.g., the reset) clears, the microcontroller 102 may cycle through a routine to ensure that the contacts are in the proper condition. For example, at time=t4 the microcontroller 102 may again operate to command the GPIO pin to the ON state for a sufficient period of time to permit the contacts to achieve their energized state, and substantially soon thereafter (e.g., time=t5), command the tri-state output to the FLOAT state to maintain the contacts in their energized state at a lower coil current of the HOLD-current level.

Another unexpected command of the GPIO pin to the FLOAT state by the microcontroller 102 may occur when the GPIO pin was in the OFF state. For example, consider the conditions of the system 100 from time=t6 to just prior to time=t7. During that time, the microcontroller 102 has been commanding the GPIO pin to the OFF state (no current being supplied through the coil of the relay 104, and no power being delivered to the AC LOAD). If at time=t7, the microcontroller 102 unexpectedly commands the GPIO pin to the FLOAT state (such as due to a reset) the contacts remain in the de-energized state (there is no change) through the unexpected condition. Indeed, since the driver circuit 108, in, conjunction with the microcontroller 102, provides the HOLD-current level to the coil (which is defined as less than the minimum turn on current for the contacts) there is insufficient current and magnetic force to transition the contacts from the de-energized state to the energized state. Thus, as is shown in FIG. 3, the coil current rises from about 0 mA to about 15 mA from time=t7 to t8, the contacts remain de-energized (open) and no power is delivered to the AC LOAD.

After the unexpected condition (e.g., the reset) clears (at time=t8), the microcontroller 102 may cycle through a routine to ensure that the contacts are in the proper condition, which in this case is the de-energized state. Thus, at time=t8 the microcontroller 102 commands the GPIO pin to the OFF state.

Figure 4:
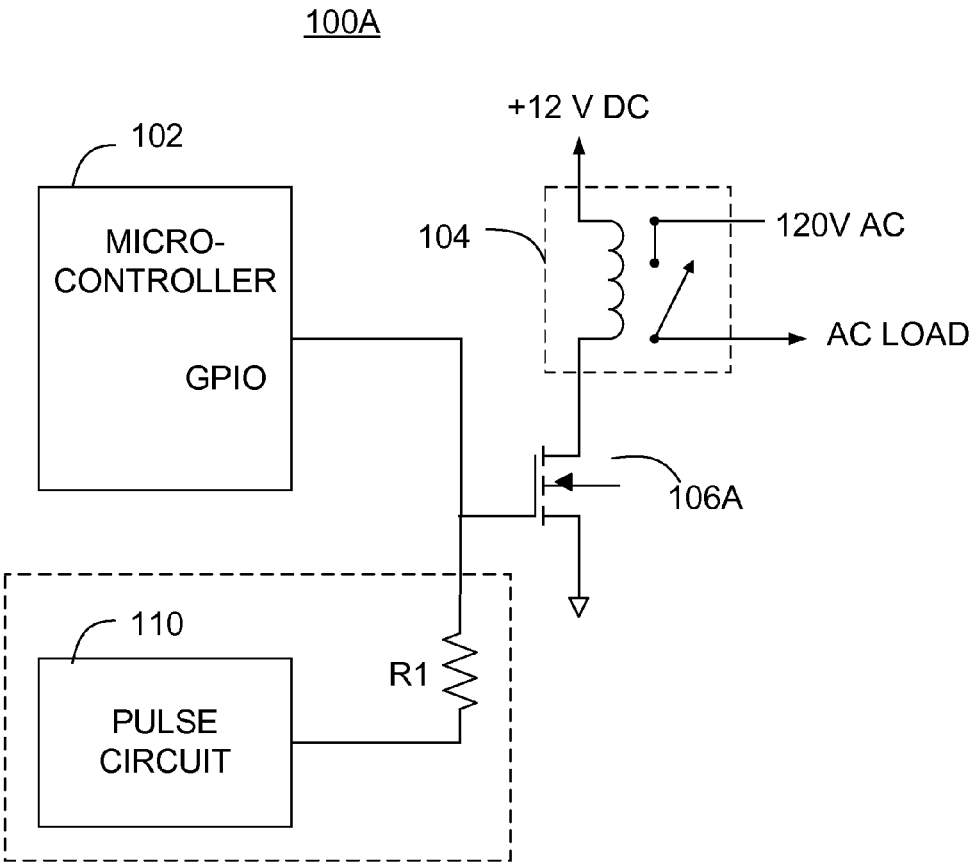
FIG. 4 is a block diagram of a circuit that is suitable for implementing the system of FIG. 2.

The above functional features of the system 100 may be implemented in many different ways, and all such implementations are intended to be covered by the invention. Among such further implementations is the system 100A illustrated in FIG. 4. The system 100A includes the microcontroller 102 and relay circuit 104 discussed previously. The switching circuit 106 may be implemented using one or more transistors 106A, where the transistors may take on any suitable type, such as a MOSFET, JFET, BJT, etc. By way of example, an n-channel MOSFET is illustrated, which has been found to work well. The transistor 106A includes a control terminal (gate), and a pair of output terminals (drain and source) coupled in series with the coil of the relay 104 to ground. In accordance with the characteristics of the n-channel MOSFET, the conductance between the drain and source is responsive to a bias voltage on the gate. As the gate voltage rises above the source voltage, the conductance of the drain-to-source path through the transistor 106A increases. The tri-state output GPIO pin of the microcontroller 102 is coupled to the gate of the transistor 106A. Such coupling may include a direct connection to the gate or an indirect connection to the gate through some resistance (not shown).

Figure 5:
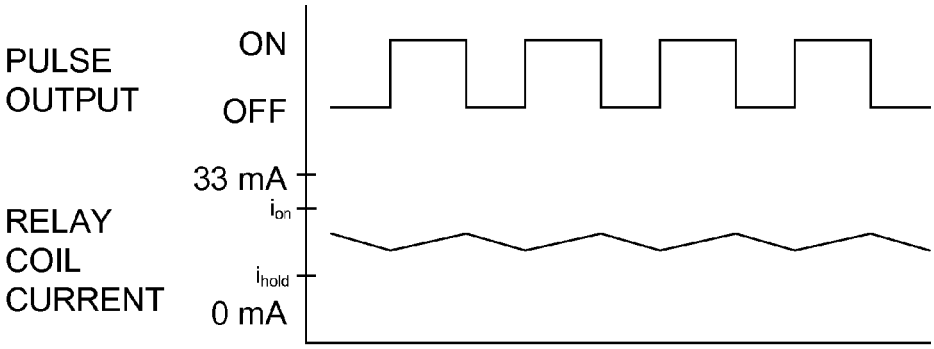
FIG. 5 is timing diagram of some of the signals within the circuit of FIG. 4.

The driver circuit 108 includes a pulse circuit 110 operating to produce a pulse voltage output signal. The pulse voltage is coupled through a series impedance, R1, to at least one of: the tri-state output GPIO pin of the microcontroller 102, and the gate of the transistor 106A. In other words, the precise connection of R1 to the transistor 106A may be a direct connection or through some other impedance (not shown). With reference to FIG. 5, which is a graph illustrating some signals of the system 100A, the pulse voltage output may be a rectangular wave with defined periodicity. By way of example, the pulse voltage output may exhibit a 55/45 duty cycle at 33 kHz (it being understood that other signal characteristics may be employed if desired and if suitable).

Turning to the operation of the system 100A, when the tri-state output GPIO pin of the microcontroller 102 is in the OFF state, there is substantially NO-current flowing through the coil. Indeed, in the OFF state, the GPIO pin operates as a low impedance current sink and draws any charge off the gate of the transistor 106A, leaving about 0 volts from gate-to-source. Thus, transistor 106A is OFF, no current flows through the coil, and the contacts are de-energized. The driver circuit 108, in combination with the microcontroller 102, produce the characteristics illustrated in the plots of FIG. 3, between times 0 to t1; t6 to t7; and t8 and thereafter.

When the tri-state output GPIO pin is in the ON state, there is TURN-ON current through the coil. Indeed, in the ON state, the GPIO pin operates as a low impedance voltage source and places charge on the gate of the transistor 106A, leaving some positive voltage from gate-to-source. By way of example, the voltage may be between 0.333 to about 5 volts or more. Thus, transistor 106A is ON, current flows through the coil, and the contacts are energized. In keeping with the examples discussed above, the impedance of the coil and drain-source conductance of the transistor 106A may be such that the current drawn through the coil is at about 33 mA when the GPIO pin is in the ON state. Thus, the driver circuit 108, in combination with the microcontroller 102, produces the characteristics illustrated in the plots of FIG. 3, between times t1 to t2; and t4 to t5.

When the tri-state output GPIO pin is in the FLOAT state there is HOLD-current through the coil. The characteristics of the GPIO pin are of a high-impedance input when in the FLOAT state. Thus, the voltage on the GPIO (and thus the gate of the transistor 106A) is established by the circuit external to the microprocessor 102. Assuming a proper value of R1 (such as significantly lower than the high-impedance of the GPIO pin) the voltage on the gate of the transistor 106A will be established by the pulse circuit 110. Thus, as shown in the top plot of FIG. 5, the gate voltage will pulse to a positive voltage and back to a zero voltage in accordance with a 45/55 duty cycle at 33 kHz. For purposes of this example, it is assumed that the high level of the pulse voltage output is between about 1-5 volts. When the pulse voltage output is high (at about 1-5 volts), the gate-to-source voltage of the transistor 106A is likewise high and the transistor 106A is conducting current. During that time, as shown in the bottom plot of FIG. 5, the current in the coil ramps up. When the pulse voltage output is low (at about 0 volts), the gate-to-source voltage of the transistor 106A is also low and the transistor 106A is off. During that time, the current in the coil ramps down. The ramp up and down in the coil continues so long as the GPIO pin is in the FLOAT state. The impedance of the coil and drain-source conductance of the transistor 106A may be set such that the average current drawn through the coil is at about 15 mA when the GPIO pin is in the FLOAT state. Recalling that the duty cycle of the pulse voltage from the pulse circuit 110 was 45% high and 55% low, the current through the coil is 0.45×33 mA=14.8 mA (i.e., about 15 mA). Consequently, the average relay coil current is at or above the minimum hold current, $i_{hold}$, and less than the minimum turn-on current level, $i_{on}$. Thus, the driver circuit 108, in combination with the microcontroller 102, produces the characteristics illustrated in the plots of FIG. 3, between times=t2 to t4; t5 to t6; and t7 to t8.

Figure 6:
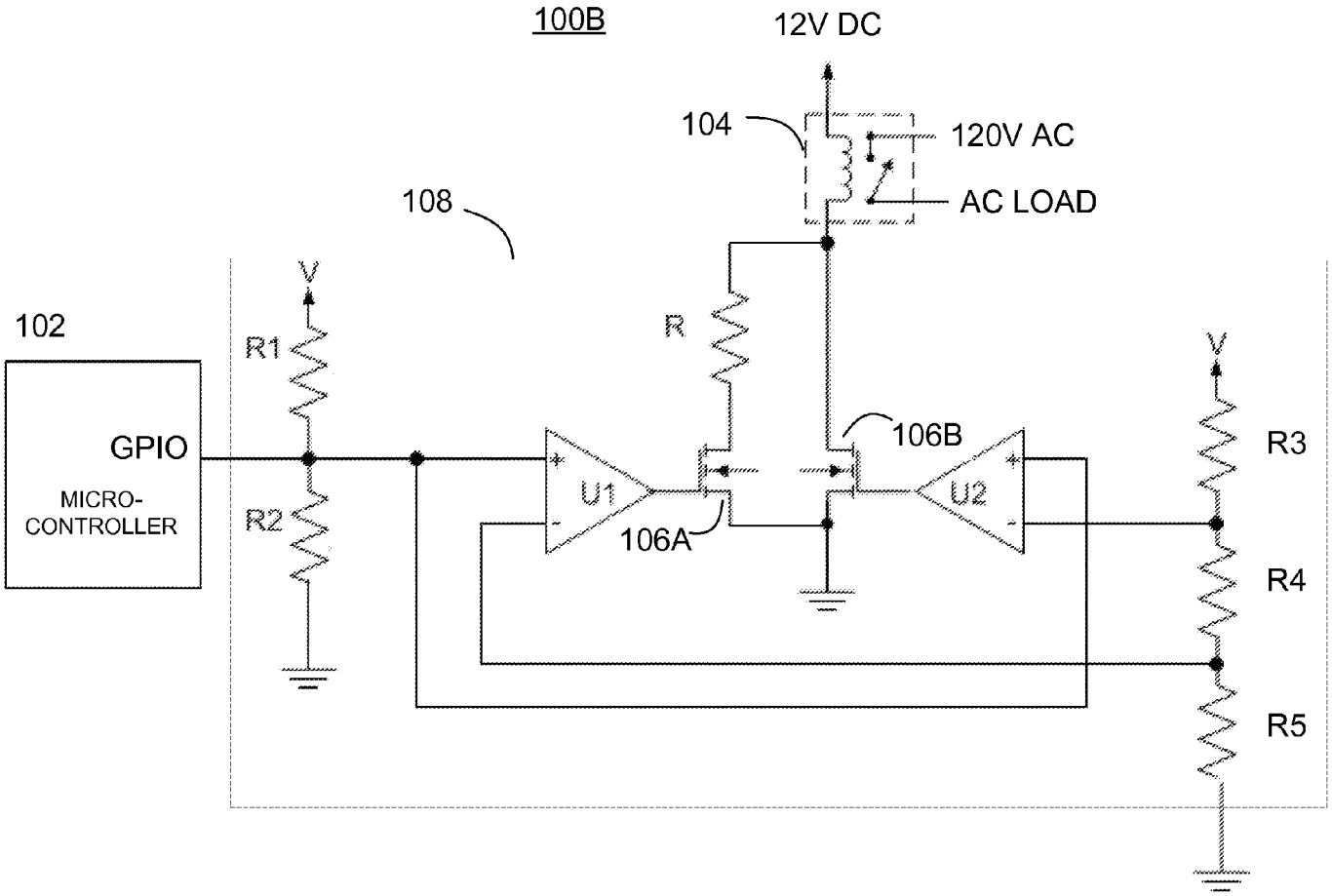
FIG. 6 is a block diagram of an alternative circuit that is suitable for implementing the system of FIG. 2.

A further system implementation is illustrated in FIG. 6. The system 100B includes the microcontroller 102 and relay circuit 104 discussed previously. The switching circuit 106 may be implemented using first and second transistors 106A and 106B, where again the transistors may take on any suitable type, such as MOSFETs, JFETs, BJTs, etc. By way of example, n-channel MOSFETs are employed. Each of the transistors 106A, 106B includes a control terminal (gate), and a pair of output terminals (drain and source) coupled in series with the coil of the relay 104 to ground. An impedance, R, is included in the series connection between the coil and the drain of the first transistor 106A. For purposes of this example, it is assumed that no series impedance is included between the coil and the drain of the second transistor 106B, however, as will be evident to a skilled artisan from the description herein, such impedance may be included so long as it is of significantly lower impedance than R. Thus, a first impedance is defined by a series aggregate of the impedance of the coil, the impedance R and the conductance of the first transistor 106A (when the transistor is on). Similarly, a second impedance is defined by a series aggregate of the impedance of the coil and the conductance of the second transistor 106B (again when the transistor is on). Consequently, the second impedance is intended to be substantially lower than the first impedance.

The driver circuit 108 includes first and second comparator circuits U1, U2, which may be implemented using any of the known and available devices. Each comparator circuit U1, U2 includes a positive input (+), a negative input (−) and an output. The outputs are responsive to voltage differences between the respective positive and negative inputs. For example, the output operates as a relatively low impedance current sink when the voltage potential of the negative input (−) is higher than the voltage potential of the positive input (+), thereby assuming a low voltage potential, e.g., about 0 volts. Conversely, the output operates as a relatively low impedance voltage source when the voltage potential of the negative input (−) is below the voltage potential of the positive input (+), thereby assuming a high voltage potential, e.g., about 1-5 volts. In some implementations, the comparator circuits exhibit "open collector" outputs, which would require some pull-up circuit (such as a resistor to a voltage source) to produce the desired high voltage potential at the output when the voltage potential of the negative input (−) is below the voltage potential of the positive input (+)

A first voltage divider comprises resistors R3, R4, and R5 coupled in series between a supply voltage V (of about 1 volt DC) and ground. Assuming that R3=R4=R5=10 Kohms, a first reference potential is defined across resistor R5, which is assumed to be about 0.333 VDC, and a second reference potential is defined across resistors R4 and R5, which is assumed to be about 0.667 VDC.

The negative input (−) of the first comparator U1 is coupled to the first reference potential, and the first output from U1 is coupled to the gate of the first transistor 106A. The negative input (−) of the second comparator U2 is coupled to the second reference potential, and the second output from U2 is coupled to the gate of the second transistor 106B.

The tri-state output GPIO pin of the microcontroller 102 is coupled to the positive terminals of the first and second comparator circuits U1, U2. A second voltage divider, comprising resistors R1 and R2, also establishes a third reference potential on the GPIO pin when such pin is in the FLOAT state. By way of example, the third reference potential is between the first and second reference potentials, e.g., about 0.5 volts.

Turning to the operation of the system 100B, when the tri-state output GPIO pin of the microcontroller 102 is in the OFF state, there is substantially NO-current flowing through the coil. Indeed, in the OFF state, the GPIO pin operates as a low impedance current sink and draws the voltage between R1 and R2 to ground, leaving about 0 volts on the positive inputs (+) of the first and second comparators U1, U2. This results in a positive net voltage (of 0.333 volts) on the negative inputs (−) as referenced to the positive inputs (+) of the first and second comparators U1, U2. This causes the gate-to-source voltages of the first and second transistors 106A, 106B to go to zero. Thus, transistors 106A and 106B are OFF, no current flows through the coil, and the contacts are de-energized. Thus, the driver circuit 108, in combination with the microcontroller 102, produces the characteristics illustrated in the plots of FIG. 3, between times 0 to t1; t6 to t7; and t8 and thereafter.

When the tri-state output GPIO pin is in the ON state, there is TURN-ON current through the coil. Indeed, in the ON state, the GPIO pin operates as a low impedance voltage source driving the voltage between R1 and R2 to, a high voltage, leaving about 1-5 volts on the positive inputs (+) of the first and second comparators U1, U2. This results in a positive net voltage (of at least 0.333 volts) on the positive inputs (+) compared with the negative inputs (−) of the first and second comparators U1, U2. This causes the gate-to-source voltages of the first and second transistors 106A, 106B to go to some high voltage (e.g., between 1-5 volts). Thus, transistors 106A and 106B are ON, TURN-ON current flows through the coil, and the contacts are energized. In keeping with the examples discussed above, the combination of the impedance of the coil and the respective drain-to-source conductances of the transistors 106A, 106B may be such that the current drawn through the coil is at about 33 mA when the GPIO pin is in the ON state. Thus, the driver circuit 108, in combination with the microcontroller 102, produces the characteristics illustrated in the plots of FIG. 3, between times t1 to t2; and t4 to t5.

When the tri-state output GPIO pin is in the FLOAT state, there is HOLD-current through the coil. The characteristic of the GPIO pin is of a high-impedance input when in the FLOAT state. Thus, the voltage on the GPIO is established by the first voltage divider, specifically the first reference potential of 0.5 volts. This results in a positive net voltage (of 0.333 volts) on the negative input (−) as referenced to the positive input (+) of the second comparator U2. Thus, the gate-to-source voltage of the second transistor 106B is zero, transistor 106B is OFF, and no current flows through the coil into the drain of the second transistor 106B. In contrast, the first reference potential of 0.5 volts results in a positive net voltage (of at least 0.333 volts) on the positive input (+) compared with the negative input (−) of the first comparator U1. This causes the gate-to-source voltage of the first transistor 106A to go to some high voltage (e.g., between 1-5 volts). Thus, transistor 106A is ON, and HOLD-current flows through the coil, through the resistor R, and through the drain-to-source of the first transistor 106A. Thus, assuming that the first impedance is properly set, the current drawn through the coil is at about 15 mA when the GPIO pin is in the FLOAT state. In other words, the relay coil current is at or above the minimum hold current, $i_{hold}$, and less than the minimum turn-on current level, $i_{on}$. Thus, the driver circuit 108, in combination with the microcontroller 102, produces the characteristics illustrated in the plots of FIG. 3, between times=t2 to t4; t5 to t6; and t7 to t8.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An apparatus, comprising:

at least one electromechanical relay including a coil and at least one pair of contacts, the contacts transitioning between a de-energized state and an energized state in response to current through the coil;

a microcontroller having at least one tri-state output operating to produce ON, OFF, and FLOAT states; and a driver circuit operating, in conjunction with the tri-state output of the microcontroller, to control the current through the coil of the relay such that:

(i) a transition of the tri-state output from OFF to FLOAT maintains the contacts of the relay in their de-energized state through the transition, and (ii) a transition of the tri-state output from ON to FLOAT maintains the contacts of the relay in their energized state through the transition.

2. The apparatus of claim 1, wherein the driver circuit further operates, in conjunction with the tri-state output of the microcontroller, to control the current through the coil of the relay such that:

(i) there is substantially no current flowing through the coil when the tri-state output is in the OFF state, and (ii) there is sufficient current flowing through the coil, and magnetic force therefrom, to transition from their de-energized state to their energized state when the tri-state output is in the ON state.

3. The apparatus of claim 1, wherein the relay operates to produce magnetic force as a function of the current through the coil, and the at least one pair of contacts is in magnetic communication with the coil, wherein the contacts are one of:

(i) normally-open, whereby the contacts are in the de-energized state, in which they are open and interrupt a current path therebetween, in response to an insufficiently high current through, and magnetic force from, the coil, and whereby the contacts are in the energized state, in which they are closed and create a current path therebetween, in response to a sufficiently high current through, and magnetic force from, the coil, and (ii) a normally closed, whereby the contacts are in the de-energized state, in which they are closed and create a current path therebetween, in response to an insufficiently high current through, and magnetic force from, the coil, and whereby the contacts are in the energized state, in which they are open and interrupt a current path therebetween, in response to a sufficiently high current through, and magnetic force from, the coil.

4. The apparatus of claim 3, wherein:

the coil of the relay requires at least a turn-on current level in order to produce sufficient magnetic force to transition the contacts from their de-energized state to their energized state; and the coil of the relay requires at least a hold current level, which is substantially lower than the turn-on current level, in order to produce sufficient magnetic force to maintain the contacts in their energized state once they have transitioned from their de-energized state to their energized state.

5. The apparatus of claim 4, wherein the driver circuit operates, in conjunction with the tri-state output of the microcontroller, to control a magnitude of the current through the coil of the relay to be at least the on-current level when the tri-state output is in the ON state.

6. The apparatus of claim 4, wherein the driver circuit operates, in conjunction with the tri-state output of the microcontroller, to control a magnitude of the current through the coil of the relay to a level between the hold current and less than the turn-on current level, when the tri-state output of the microcontroller is in the FLOAT state.

7. The apparatus of claim 6, wherein the microcontroller operates to command the tri-state output to the ON state for a sufficient period of time to permit the contacts to achieve their energized state, and substantially soon thereafter, command the tri-state output to the FLOAT state to maintain the contacts in their energized state.

8. The apparatus of claim 4, wherein the driver circuit operates, in conjunction with the tri-state output of the microcontroller, to control a magnitude of the current through the coil of the relay to a level between the hold current and less than the turn-on current level, when the tri-state output of the microcontroller at least one of: (i) transitions from OFF to FLOAT; and (ii) transitions from ON to FLOAT.

9. The apparatus of claim 1, wherein the contacts of the relay are coupled between a source of power and a load.

10. An apparatus, comprising:

at least one electromechanical relay including a coil and at least one pair of contacts, the contacts transitioning from a de-energized state to an energized state in response to current through the coil;

a transistor having a control terminal, and a pair of output terminals coupled in series with the coil of the relay, the output terminals being responsive to bias on the control terminal;

a microcontroller having at least one tri-state output operating to produce ON, OFF, and FLOAT states, the tri-state output being coupled to the control terminal of the transistor; and a pulse circuit operating to produce a pulse voltage output signal, which is coupled, through a series impedance, to at least one of the tri-state output of the microcontroller, and the control terminal of the transistor, such that:

(i) a transition of the tri-state output from OFF to FLOAT maintains the contacts of the relay in their de-energized state through the transition, and (ii) a transition of the tri-state output from ON to FLOAT maintains the contacts of the relay in their energized state through the transition.

11. The apparatus of claim 10, wherein the relay operates to:

cause the contacts to transition from the de-energized state to the energized state only when a magnitude of a current through the coil reaches or exceeds a turn-on current level, and thereafter cause the contacts to maintain the energized state so long as the magnitude of a current through the coil reaches or exceeds a hold current level, which is substantially lower than the turn-on current level.

12. The apparatus of claim 11, wherein the pulse voltage output has no effect on the control terminal of the transistor when:

the tri-state output is in the OFF state, whereby the tri-state output forces the control terminal of the transistor to a bias voltage at which the current flowing through the coil is below the hold-current level and the contacts are in the de-energized state; and the tri-state output is in the ON state, whereby the tri-state output forces the control terminal of the transistor to a bias voltage at which the current flowing through the coil reaches or exceeds the turn-on current level and the contacts are in the energized state.

13. The apparatus of claim 11, wherein the pulse voltage output presents a pulse bias voltage on the control terminal of the transistor when the tri-state output is in the FLOAT state, whereby the output terminals of the transistor cause a pulsed current to flow through the coil, an average of which pulsed current is between the hold current and less than the turn-on current level.

14. The apparatus of claim 13, wherein the microcontroller operates to command the tri-state output to the ON state for a sufficient period of time to permit the contacts to achieve their energized state, and substantially soon thereafter, command the tri-state output to the FLOAT state to maintain the contacts in their energized state.

15. The apparatus of claim 13, wherein the pulse voltage output presents a pulse bias voltage on the control terminal of the transistor, and the output terminals of the transistor cause the pulsed current to flow through the coil, when the tri-state output of the microcontroller at least one of: (i) transitions from OFF to FLOAT; and (ii) transitions from ON to FLOAT.

16. The apparatus of claim 10, wherein the transistor is one of a MOSFET, JFET, and bipolar junction transistor.

17. An apparatus, comprising:

at least one electromechanical relay including a coil and at least one pair of contacts, the contacts transitioning from a de-energized state to an energized state in response to current through the coil;

a first transistor having a control terminal, and a pair of output terminals coupled in series with the coil of the relay, the output terminals being responsive to bias on the control terminal, and a first impedance being defined by a series aggregate of the coil and the first transistor;

a second transistor having a control terminal, and a pair of output terminals coupled in series with the coil of the relay, the output terminals being responsive to bias on the control terminal, and a second impedance being defined by a series aggregate of the coil and the second transistor, the second impedance being substantially lower than the first impedance;

a first comparator circuit having a positive input, a negative input and a first output responsive to a voltage difference between the positive and negative inputs, the negative input of the first comparator being coupled to a first reference potential, and the first output being coupled to the control terminal of the first transistor;

a second comparator circuit having a positive input, a negative input and a second output responsive to a voltage difference between the positive and negative inputs, the negative input of the second comparator being coupled to a second reference potential, which is higher than the first reference potential, and the second output being coupled to the control terminal of the second transistor;

a microcontroller having at least one tri-state output operating to produce ON, OFF, and FLOAT states, the tri-state output being coupled to the positive terminals of the first and second comparator circuits; and a bias circuit operating to produce a third reference voltage on the positive inputs of the first and second comparator circuits only when the tri-state output of the microcontroller is in the FLOAT state, the third reference voltage being between the first and second reference voltages.

18. The apparatus of claim 17, wherein:

the tri-state output being in the ON state forces the positive inputs of the first and second comparator circuits above the second reference voltage, thereby causing the first and second outputs to bias the first and second transistors to conduct current; and the second impedance is sufficiently low to ensure that the second transistor draws sufficient current through the coil to cause the contacts to transition from the de-energized state to the energized state.

19. The apparatus of claim 17, wherein the tri-state output being in the OFF state forces the positive inputs of the first and second comparator circuits below the first reference voltage, thereby causing the first and second outputs to bias the first and second transistors to conduct insufficient current through the coil to cause the contacts to transition from the energized state to the de-energized state.

20. The apparatus of claim 17, wherein:

the relay operates to: (i) cause the contacts to transition from the de-energized state to the energized state only when a magnitude of a current through the coil reaches or exceeds a turn-on current level, and (ii) thereafter cause the contacts to maintain the energized state so long as the magnitude of a current through the coil reaches or exceeds a hold current level, which is substantially lower than the turn-on current level;

the tri-state output being in the FLOAT state permits the bias circuit to place the third reference voltage on the positive inputs of the first and second comparator circuits, thereby causing the first output to bias the first transistor to conduct current through the coil and causing the second output to bias the second transistor off;

the first impedance is such that the first transistor draws a magnitude of current through the coil that is between the hold current and less than the turn-on current level.

* * * * *